US007633327B1

(12) United States Patent
Zhang et al.

(10) Patent No.: US 7,633,327 B1
(45) Date of Patent: Dec. 15, 2009

(54) CIRCUITRY AND METHOD FOR INTEGRATING CONTINUOUS CURRENT AND DISCRETE CHARGE

(75) Inventors: Zhenyong Zhang, Sunnyvale, CA (US); Jian-Yi Wu, San Ramon, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 12/210,504

(22) Filed: Sep. 15, 2008

(51) Int. Cl.
*G06G 7/18* (2006.01)

(52) U.S. Cl. ..... 327/337; 327/91; 327/554

(58) Field of Classification Search ..... 327/91, 327/93–96, 336, 337, 339, 341, 344, 345, 327/554

See application file for complete search history.

(56) References Cited

U.S. PATENT DOCUMENTS 7,157,955 B2 * 1/2007 Wei ..... 327/337
7,157,956 B2 * 1/2007 Wei ..... 327/337

* cited by examiner

*Primary Examiner*—Lincoln Donovan
*Assistant Examiner*—Patrick O'Neill
(74) *Attorney, Agent, or Firm*—Vedder Price P.C.

(57) ABSTRACT

A signal integrator and method for integrating a continuous current and a discrete charge in which the discrete charge is provided for integration during multiple overlapping time intervals.

15 Claims, 3 Drawing Sheets

CIRCUITRY AND METHOD FOR INTEGRATING CONTINUOUS CURRENT AND DISCRETE CHARGE

BACKGROUND

1. Field of the Invention

The present invention relates to signal integrators, and in particular, to signal integrators for integrating continuous and discrete signals.

2. Prior Art

Achieving linear integration of two different types of inputs, such as a continuous current and a discrete charge, is complicated by the slewing of the integrated signal caused by the effects of integrating discrete charges along with the continuous current. Compensating for these nonlinear effects, e.g., through the use of filters when possible, increase the size and complexity of the system, as well as power consumption, any and all of which are problematic for many applications, particularly in mobile devices or instrumentation systems.

Referring to FIG. 1A, a conventional circuit for integrating continuous current and discrete charge receives a continuous output current I resulting from the application of an input voltage VIN to an input resistance R1. The discrete charge Q is received from an input capacitance C1 which is alternately charged and discharged by the application of reference voltages VREF1, VREF2 and a common mode voltage VCM (discussed in more detail below). This current I and charge Q are summed at a virtual ground VG formed at the inverting input electrode of an operational amplifier A1 whose non-inverting input electrode is grounded. Due to the feedback capacitance Cf connected between the inverting input electrode and output electrode of the operational amplifier A1 (in accordance with well known integrator principles), the summed current I and charge Q is accumulated on the feedback capacitance Cf forced by the virtual ground VG at the inverting input electrode of the operational amplifier A1.

The input capacitance C1 is alternately charged and discharged by the alternate application of the reference voltages VREF1, VREF2 and common mode voltage VCM during alternate time intervals, e.g., mutually exclusive, in accordance with switch control signals F1, F2 having mutually opposing signal assertion and de-assertion phases.

Referring to FIG. 1B, the input capacitance C1 is disconnected from the virtual ground at the inverting input electrode of the operational amplifier A1 during assertion of signal F2 (reset phase), and its electrodes, or plates, are set to a reference voltage VREF1 and the common mode voltage VCM. During assertion of signal F1 (integrating phase), the top electrode of the input capacitance C1 is connected to the virtual ground at the inverting input electrode of the operational amplifier A1, while the bottom electrode of the input capacitance C1 is connected to the reference voltage VREF2. The resulting voltage difference VREF1-VREF2 across the input capacitance C1 produces the charge Q, which is transferred and accumulated on the feedback capacitance Cf. Because the voltage across the input capacitance cannot be changed instantly, there will be a voltage transient at the bottom electrode of the input capacitance C1, as well as at the top electrode and virtual ground VG. As is well known, the transconductance Gm of the operational amplifier A1 is dependent upon its input voltage, i.e., voltage applied between its inverting and non-inverting electrodes. Accordingly, any voltage transient appearing across these input electrodes alters the transconductance Gm and, therefore, disturbs linear operation of the operational amplifier, in which, in this application, results in a disturbance in linear integration of the continuous input current I. As the voltage transient at the virtual ground VG increases, distortions in the integrated signal increase as well.

SUMMARY

In accordance with the presently claimed invention, a signal integrator and method are provided for linear integration of a continuous current and a discrete charge in which the discrete charge is provided for integration during multiple overlapping time intervals.

In accordance with one embodiment of the presently claimed invention, signal integration circuitry for integrating a continuous current and a discrete charge includes:

signal integration circuitry including a plurality of signal electrodes and responsive to a continuous current and a discrete charge by providing an integrated signal;

switched capacitive circuitry responsive to a plurality of voltages and a portion of a plurality of control signals by providing the discrete charge during a first one of a plurality of time intervals; and first switch circuitry coupled between the switched capacitive circuitry and a portion of the plurality of signal electrodes and responsive to another portion of the plurality of control signals by conveying the discrete charge, wherein the discrete charge is conveyed to

- a first one of the portion of the plurality of signal input electrodes during the first one of the plurality of time intervals, and
- each remaining one of the portion of the plurality of signal input electrodes during respective successively latter portions of the first one of the plurality of time intervals.

In accordance with another embodiment of the presently claimed invention, signal integration circuitry for integrating a continuous current and a discrete charge includes:

a signal electrode to convey a continuous current;

a plurality of electrodes to convey a plurality of voltages;

an operational amplifier circuit with input and output electrodes;

a feedback capacitance coupled between the input and output electrodes;

an input resistance coupled between the signal and input electrodes;

a plurality of additional resistances coupled to the input electrode;

first switch circuitry coupled to the plurality of electrodes;

second switch circuitry coupled to the first switch circuitry and the plurality of additional resistances; and an input capacitance coupled to the first and second switch circuitries;

wherein

- the first switch circuitry is responsive to a portion of a plurality of control signals by conveying the plurality of voltages during first and second time intervals, respectively,
- the input capacitance is responsive to the plurality of voltages by providing a discrete charge during the first time interval, and
- the second switch circuitry is responsive to another portion of the plurality of control signals by conveying the discrete charge to
  - a first one of the plurality of additional resistances during the first time interval, and
  - each remaining one of the plurality of additional resistances during respective successively latter portions of the first time interval.

In accordance with another embodiment of the presently claimed invention, a method for integrating a continuous current and a discrete charge includes:

receiving a continuous current;

receiving a discrete charge during a first one of a plurality of time intervals;

converting the discrete charge to a first one of a plurality of conversion currents during the first one of the plurality of time intervals;

converting the discrete charge to each remaining one of the plurality of conversion currents during respective successively latter portions of the first one of the plurality of time intervals; and integrating the continuous current and the plurality of conversion currents to provide an integrated signal.

DETAILED DESCRIPTION

The following detailed description is of example embodiments of the presently claimed invention with references to the accompanying drawings. Such description is intended to be illustrative and not limiting with respect to the scope of the present invention. Such embodiments are described in sufficient detail to enable one of ordinary skill in the art to practice the subject invention, and it will be understood that other embodiments may be practiced with some variations without departing from the spirit or scope of the subject invention.

Throughout the present disclosure, absent a clear indication to the contrary from the context, it will be understood that individual circuit elements as described may be singular or plural in number. For example, the terms "circuit" and "circuitry" may include either a single component or a plurality of components, which are either active and/or passive and are connected or otherwise coupled together (e.g., as one or more integrated circuit chips) to provide the described function. Additionally, the term "signal" may refer to one or more currents, one or more voltages, or a data signal. Within the drawings, like or related elements will have like or related alpha, numeric or alphanumeric designators. Further, while the present invention has been discussed in the context of implementations using discrete electronic circuitry (preferably in the form of one or more integrated circuit chips), the functions of any part of such circuitry may alternatively be implemented using one or more appropriately programmed processors, depending upon the signal frequencies or data rates to be processed.

Figure 1A:
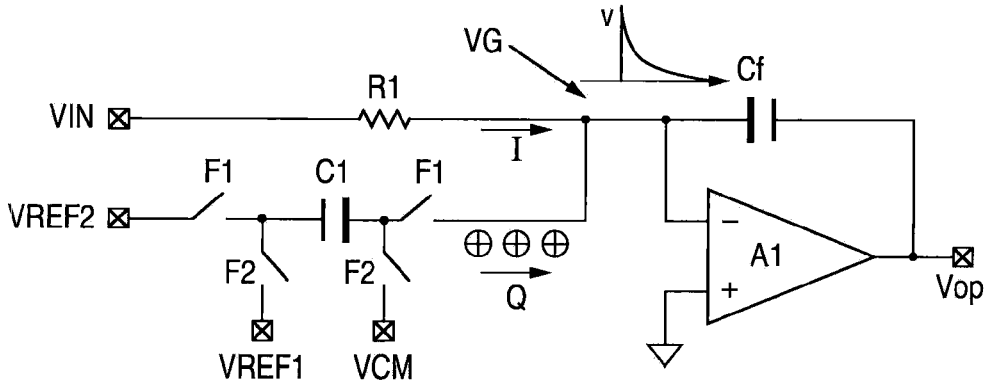
FIG. 1A (PRIOR ART)
FIG. 1A is a schematic diagram of a conventional circuit for integrating continuous current and discrete charge.
Figure 1B:
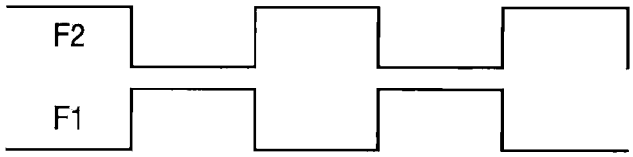
FIG. 1B (PRIOR ART)
FIG. 1B is a signal timing diagram for the switches of FIG. 1A.
Figure 2A:
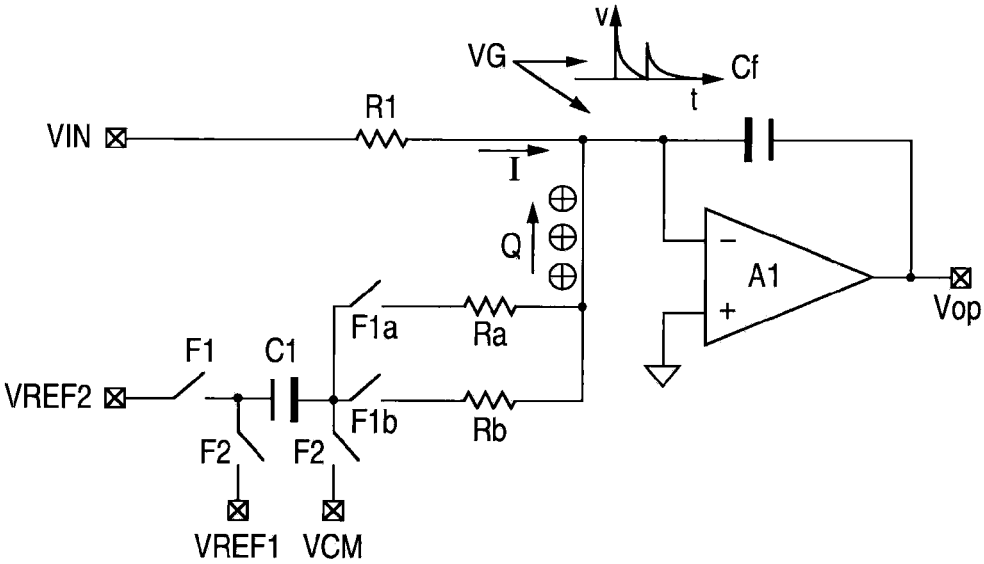
FIG. 2A is a schematic diagram of a circuit for integrating continuous current and discrete charge in accordance with one embodiment of the presently claimed invention.

Referring to FIG. 2A, circuitry for integrating continuous current and discrete charge in accordance with one embodiment of the presently claimed invention adds additional input resistances Ra, Rb and corresponding switches F1*a*, F1*b* for applying the discrete charge Q in multiple phases. For example, in this particular embodiment, the discrete charge Q is applied in two phases via the two additional input resistances Ra, Rb and corresponding switches F1*a*, F1*b*. (As discussed in more detail below, the charge Q can be applied in virtually any number of phases, as desired.).

Figure 2B:
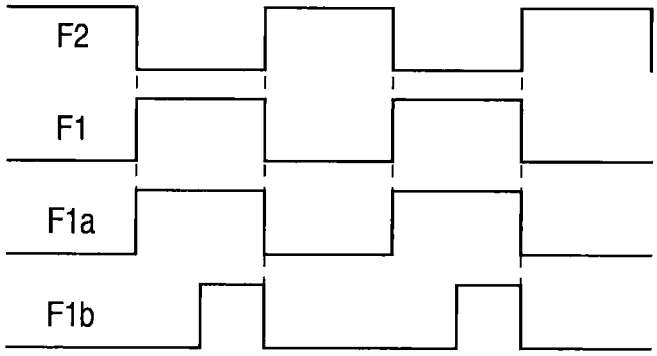
FIG. 2B is a signal timing diagram for the switches of FIG. 2A.

Referring to FIG. 2B, the integrating phase, i.e., during the assertion of switch control signal F1, is divided into two sub-phases F1*a*, F1*b*. Switch control signal F1*a* is asserted during assertion of signal F1 (and can be contemporaneous with assertion of signal F1). Switch control signal F1*b* is asserted during a latter portion of the assertion interval for signal F1*a*. Accordingly, switch F1*a* is turned on with the discrete charge Q applied through resistor Ra during the entire integrating phase, while switch F1*b* is turned on with the discrete charge Q applied through resistor Rb for the shorter, latter time interval during assertion of signal F1*b*. The first resistance Ra is greater than the second resistance Rb (Ra>Rb). (The "on" resistances of each of the input switches F1*a*, F1*b* are preferably significantly smaller than the input resistances Ra, Rb.). Therefore, the sum of the first resistance Ra and "on" resistance Rf1*a* of switch F1*a* will be greater than the sum of the second resistance Rb and "on" resistance Rf1*b* of switch F1*b*. Since the sum of resistance Ra and "on" resistance Rf1*a* of switch F1*a* is greater, when switch F1*a* is initially turned on at the beginning of the assertion of signal F1*a*, the transfer of the charge Q from the input capacitance C1 appears more like a current source with a large internal resistance continuously injecting a small current into the virtual ground VG. Hence, the transient voltage appearing at the virtual ground VG is very small.

Later, during assertion of signal F1*a* and upon assertion of signal F1*b*, due to the charge transfer during the earlier portion of the integrating phase, i.e., earlier during the assertion of signal F1*a*, the voltage difference across the input capacitance C1 is smaller than it was at the beginning of the integrating phase, i.e., upon assertion of signal F1*a*. Accordingly, during assertion of signal F1*b*, i.e., with switch F1*b* closed and the discrete charge Q now also being applied via the second input resistance Rb, even with the second resistance Rb being less than the first resistance Ra, the voltage at virtual ground VG will more closely follow the voltage at the bottom electrode of the input capacitance C1, and the voltage transient at virtual ground VG will be small.

With a well designed operational amplifier A1, i.e., an operational amplifier operating very nearly in accordance with ideal operating assumptions (which is increasingly common with current integrated operational amplifiers circuits), and appropriate resistance values for the input resistances Ra, Rb, it can be assured that the voltage transients appearing at the virtual ground VG will be significantly smaller, thereby ensuring a substantially linear integration of the continuous input current I. Additionally, a more complete transfer of the discrete charge Q from the input capacitance C1 to the feedback capacitance Cf is achieved, thereby significantly reducing any settling error within the integrated output signal VOP. This, in turn, ensures a highly linear integration of the discrete charge Q from the input capacitance C1.

Figure 3A:
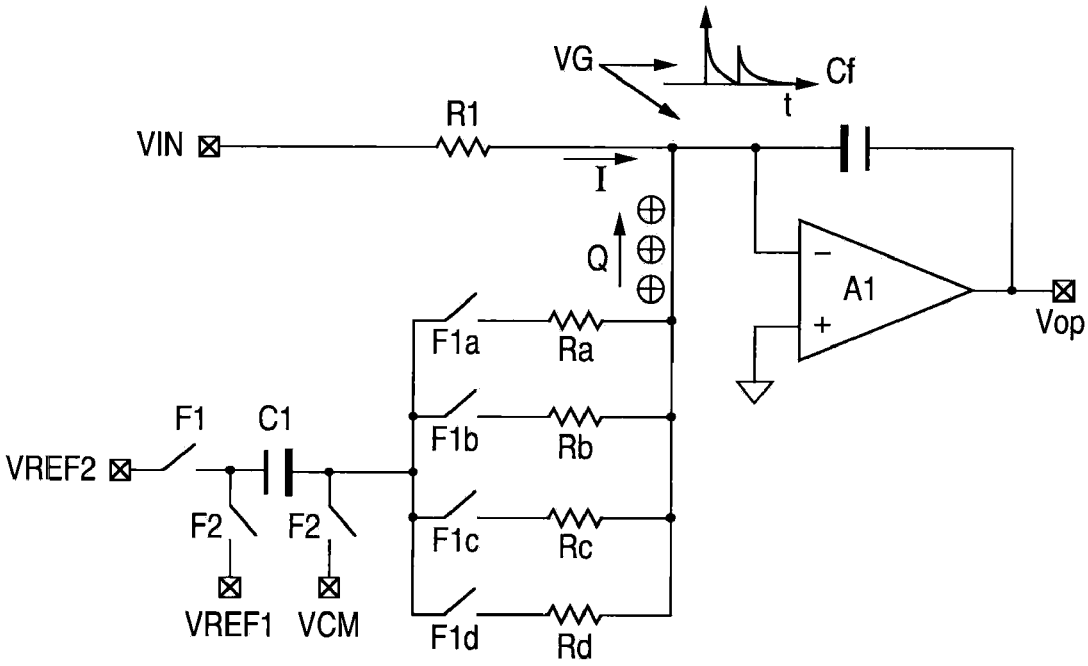
FIG. 3A is a schematic diagram of a circuit for integrating continuous current and discrete charge in accordance with another embodiment of the presently claimed invention.
Figure 3B:
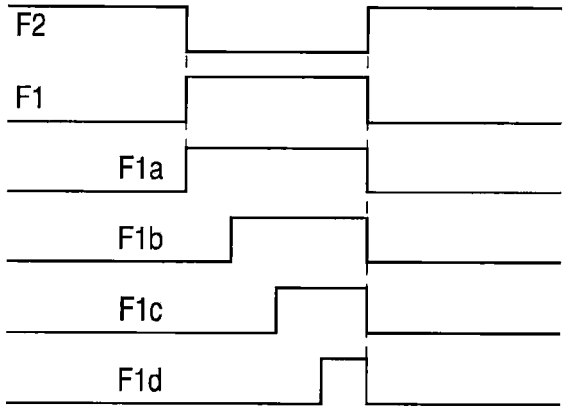
FIG. 3B is a signal timing diagram for the switches of FIG. 3A.

Referring to FIGS. 3A and 3B, this switching technique for applying the discrete charge in multiple phases can be extended to more than two phases, or branches. In this example, four phases, or branches, are used for applying the discrete charge Q for integration. As discussed above, the first application of the discrete charge Q occurs during assertion of signal F1*a*, which occurs during (and may be coincident with) assertion of signal F1 (integrating phase). During assertion of signal F1*a*, additional applications of the discrete charge Q occur during respective successively latter portions of the time interval defined by the assertion of signal F1*a*, as shown. Hence, the discrete charge Q from the input capacitance C1 is applied via switch F1*a* and resistance Ra during assertion of signal F1*a*, via switch F1*b* and resistance Rb during assertion of signal F1*b*, via switch F1*c* and resistance Rc during assertion of signal F1*c*, and via switch F1*d* and resistance Rd during assertion of signal F1*d*. As discussed above, these input resistances Ra, Rb, Rc, Rd are successively smaller in value (i.e., Ra>Rb>Rc>Rd). The duty cycles of the signal assertions for the switch control signals F1*a*, F1*b* can be adjusted for the desired performance.

Figure 4:
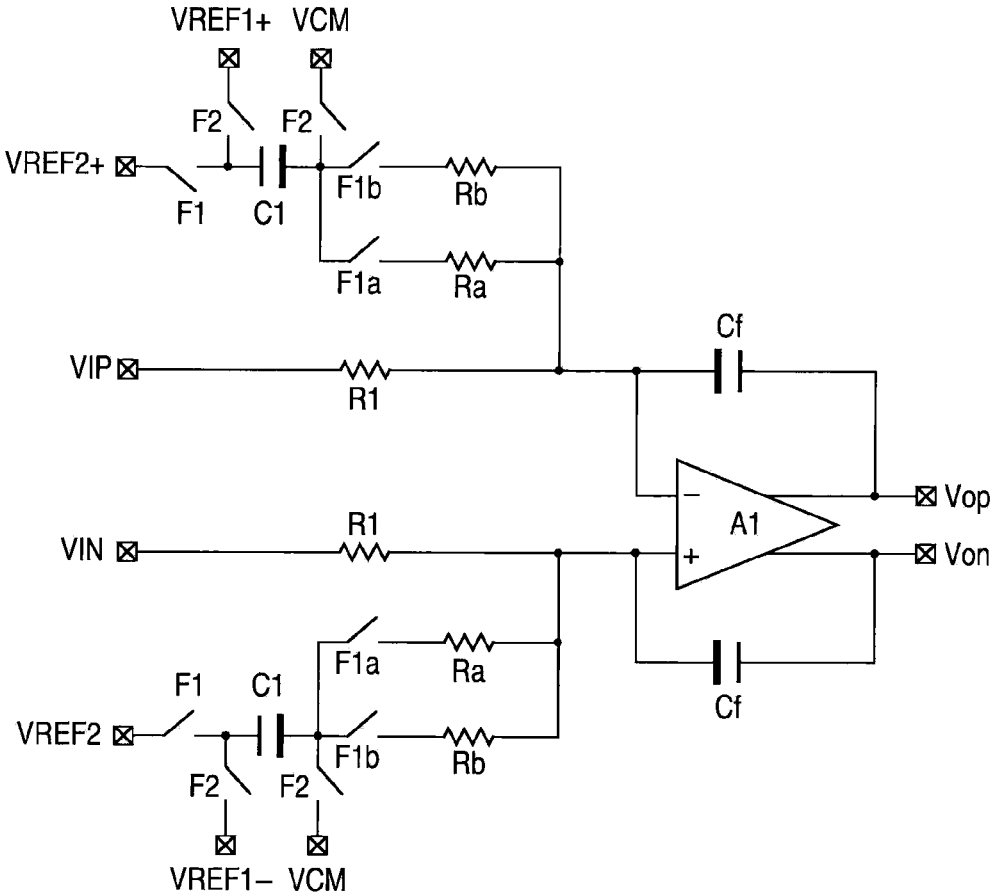
FIG. 4 is a schematic diagram of a differential implementation of the circuit of FIG. 2A for integrating continuous current and discrete charge in accordance with another embodiment of the presently claimed invention.

Referring to FIG. 4, this switching technique for applying the discrete charge can be extended to a differential signal implementation as well. While similar to the single ended implementation of FIG. 2A, this circuit receives its continuous current via respective input resistances R1 as a differential signal VIP-VIN rather than as a single ended signal VIN, and also receives its discrete charge differentially via respective input resistances Ra, Rb and switches F1*a*, F1*b* for each differential signal phase. The resulting integrated signal phases for the differential output signal VOP-VON appear across respective feedback capacitances Cf for the operational amplifier A1. Operation of this circuit for each differential signal phase is similar to that described above for the single ended circuit of FIG. 2A.

As discussed above, by using multiple branches of switches operating in multiple steps, or phases, during the integrating phase, an otherwise large voltage transient appearing at the virtual ground of the operational amplifier is reduced, e.g., in correspondence to the number of phases when integrating the discrete charge. This allows improved linear performance for integrating the continuous current, as well as improved transfer of the discrete charge. Accordingly, overall signal integration is significantly more linear.

Various other modifications and alternations in the structure and method of operation of this invention will be apparent to those skilled in the art without departing from the scope and the spirit of the invention. Although the invention has been described in connection with specific preferred embodiments, it should be understood that the invention as claimed should not be unduly limited to such specific embodiments. It is intended that the following claims define the scope of the present invention and that structures and methods within the scope of these claims and their equivalents be covered thereby.

What is claimed is:

1. An apparatus including signal integration circuitry for integrating a continuous current and a discrete charge, comprising:

signal integration circuitry including a plurality of signal electrodes and responsive to a continuous current and a discrete charge by providing an integrated signal;

switched capacitive circuitry responsive to a plurality of voltages and a portion of a plurality of control signals by providing said discrete charge during a first one of a plurality of time intervals; and first switch circuitry coupled between said switched capacitive circuitry and a portion of said plurality of signal electrodes and responsive to another portion of said plurality of control signals by conveying said discrete charge, wherein said discrete charge is conveyed to a first one of said portion of said plurality of signal electrodes during said first one of said plurality of time intervals, and each remaining one of said portion of said plurality of signal electrodes during respective successively latter portions of said first one of said plurality of time intervals.

2. The apparatus of claim 1, wherein respective ones of said plurality of time intervals are mutually exclusive.

3. The apparatus of claim 1, wherein:

each one of said respective successively latter portions of said first one of said plurality of time intervals is shorter and longer than immediately preceding and following ones, respectively, of said respective successively latter portions of said first one of said plurality of time intervals; and said first one and said respective successively latter portions of said first one of said plurality of time intervals terminate substantially simultaneously.

4. The apparatus of claim 1, wherein said signal integration circuitry comprises:

an operational amplifier circuit with input and output electrodes;

a feedback capacitance coupled between said input and output electrodes; and a plurality of resistances each of which is coupled between a respective one of said plurality of signal electrodes and said input electrode.

5. The apparatus of claim 1, wherein said switched capacitive circuitry comprises:

capacitive circuitry including first and second capacitance electrodes;

a plurality of voltage electrodes to convey said plurality of voltages; and second switch circuitry coupled between said plurality of voltage electrodes and said first and second capacitance electrodes, and responsive to said portion of said plurality of control signals by conveying said plurality of voltages to said first and second capacitance electrodes during said first one and a second one of said plurality of time intervals.

6. The apparatus of claim 1, wherein said first switch circuitry comprises a plurality of signal switches each of which is coupled between said switched capacitive circuitry and a respective one of said portion of said plurality of signal electrodes and responsive to a respective one of said another portion of said plurality of control signals by conveying said discrete charge.

7. An apparatus including signal integration circuitry for integrating a continuous current and a discrete charge, comprising:

a signal electrode to convey a continuous current;

a plurality of electrodes to convey a plurality of voltages;

an operational amplifier circuit with input and output electrodes;

a feedback capacitance coupled between said input and output electrodes;

an input resistance coupled between said signal and input electrodes;

a plurality of additional resistances coupled to said input electrode;

first switch circuitry coupled to said plurality of electrodes;

second switch circuitry coupled to said first switch circuitry and said plurality of additional resistances; and an input capacitance coupled to said first and second switch circuitries;

wherein said first switch circuitry is responsive to a portion of a plurality of control signals by conveying said plurality of voltages during first and second time intervals, respectively, said input capacitance is responsive to said plurality of voltages by providing a discrete charge during said first time interval, and said second switch circuitry is responsive to another portion of said plurality of control signals by conveying said discrete charge to a first one of said plurality of additional resistances during said first time interval, and each remaining one of said plurality of additional resistances during respective successively latter portions of said first time interval.

8. The apparatus of claim 7, wherein said first and second time intervals are mutually exclusive.

9. The apparatus of claim 7, wherein:

each one of said respective successively latter portions of said first time interval is shorter and longer than immediately preceding and following ones, respectively, of said respective successively latter portions of said first time interval; and said first and said respective successively latter portions of said first time interval terminate substantially simultaneously.

10. The apparatus of claim 7, wherein said first switch circuitry comprises:

a first switch circuit coupled between a first portion of said plurality of electrodes and said input capacitance; and a second switch circuit coupled between a second portion of said plurality of electrodes and said input capacitance.

11. The apparatus of claim 7, wherein said second switch circuitry comprises a plurality of switch circuits each of which is coupled between said input capacitance and a respective one of said plurality of additional resistances.

12. A method for integrating a continuous current and a discrete charge, comprising:

receiving a continuous current;

receiving a discrete charge during a first one of a plurality of time intervals;

converting said discrete charge to a first one of a plurality of conversion currents during said first one of said plurality of time intervals;

converting said discrete charge to each remaining one of said plurality of conversion currents during respective successively latter portions of said first one of said plurality of time intervals; and integrating said continuous current and said plurality of conversion currents to provide an integrated signal.

13. The method of claim 12, wherein respective ones of said plurality of time intervals are mutually exclusive.

14. The method of claim 12, wherein:

each one of said respective successively latter portions of said first one of said plurality of time intervals is shorter and longer than immediately preceding and following ones, respectively, of said respective successively latter portions of said first one of said plurality of time intervals; and said first one and said respective successively latter portions of said first one of said plurality of time intervals terminate substantially simultaneously.

15. The method of claim 12, further comprising:

charging a capacitance during said first one of said plurality of time intervals to provide said discrete charge; and discharging said capacitance during a second one of said plurality of time intervals.

* * * * *